US007355469B2

(12) United States Patent
Shimizu

(10) Patent No.: US 7,355,469 B2
(45) Date of Patent: Apr. 8, 2008

(54) DC POWER SUPPLY VOLTAGE REGULATOR CIRCUIT

(75) Inventor: Kan Shimizu, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 87 days.

(21) Appl. No.: 11/481,335

(22) Filed: Jul. 3, 2006

(65) Prior Publication Data

US 2007/0001656 A1 Jan. 4, 2007

(30) Foreign Application Priority Data

Jul. 4, 2005 (JP) ..... 2005-195195

(51) Int. Cl.
*G05F 1/10* (2006.01)

(52) U.S. Cl. ..... 327/541

(58) Field of Classification Search ..... 327/534, 327/535, 537, 538, 540, 541, 543
See application file for complete search history.

(56) References Cited

U.S. PATENT DOCUMENTS 5,373,226 A * 12/1994 Kimura ..... 323/313
7,205,827 B2 * 4/2007 Leung et al. ..... 327/540

OTHER PUBLICATIONS

Hnatek, "Applications Of Linear Integrated Circuits," pp. 83-85, John Wiley & Sons, 1975.
Okamuara, "Design of OP AMP (Second Series)," CQ Publishing Co., Ltd., Tokyo, Japan, 1st Ed., pp. 68-71, Figs. 3-23, Nov. 5, 1978.

* cited by examiner

*Primary Examiner*—Jeffrey Zweizig
(74) *Attorney, Agent, or Firm*—DLA Piper US LLP

(57) ABSTRACT

A resistor element is inserted between an output terminal of an output transistor and an output terminal of a regulator circuit. A signal, which is taken out of a connection node between the output terminal of the output transistor and the resistor element, is used for phase compensation. Thereby, oscillation is prevented from being caused by a phase delay due to a capacitive load which is connected to the output of the regulator circuit.

17 Claims, 3 Drawing Sheets

(Current drivin performance; PM1>PM2, resistance value; R1 ≪ R2)

DC POWER SUPPLY VOLTAGE REGULATOR CIRCUIT

CROSS-REFERENCE TO RELATED APPLICATIONS

This application is based upon and claims the benefit of priority from prior Japanese Patent Application No. 2005-195195, filed Jul. 4, 2005, the entire contents of which are incorporated herein by reference.

BACKGROUND OF THE INVENTION

1. Field of the Invention

The present invention relates to a DC power supply voltage regulator circuit, and is applied to, for example, a series-type DC power supply voltage regulator circuit.

2. Description of the Related Art

Conventionally, a series-type DC power supply voltage regulator circuit has been used in order to supply a DC voltage to a load such as an IC circuit. In usual cases, a capacitor is connected in parallel to a load, thereby to compensate a response performance of the DC power supply voltage regulator circuit. Owing to the presence of the capacitor, the load of the regulator circuit becomes a capacitive one, and a phase delay occurs due to an output resistance and a load capacitance of the regulator circuit. This makes it difficult to execute stabilization by negative feedback.

On the other hand, as a common means for preventing oscillation due to a capacitive load, there is known a technique wherein a resistor element is inserted between an output terminal of an error amplifier and the capacitive load, and a signal for phase compensation is derived from a connection node between the output terminal of the error amplifier and the resistor element, thereby preventing a phase delay due to the capacitive load from causing oscillation (see, for example, Michio Okamura, "Design of OP AMP Circuit (Second Series)", CQ Publishing Co., Ltd., Tokyo, Japan, 1st Ed., pp. 68-71, FIGS. 3-23, Nov. 5, 1978).

In this phase compensation technique, a DC component and a low-frequency component of a voltage between both ends of a capacitive load, on one hand, and a high-frequency component of an error amplifier output signal (which bypassing delayed signal on both ends of said capacitive load), on the other hand, are separately fed back to inputs of said an error amplifier. Thereby, without causing oscillation, a predetermined DC voltage and low-frequency signal are applied to the capacitive load.

In detail, a high-frequency component of the voltage at the output terminal includes a phase delay due to an output resistance of the error amplifier and the capacitive load. If this phase delay is combined with a phase delay within the error amplifier, the phase, in some cases, rotates by 360° and oscillation occurs. The DC and low-frequency components of the voltage at the output terminal are fed back to the error amplifier via a resistive element. However, since the input resistance of the error amplifier is very high, the DC component of the voltage at the output terminal is exactly fed back to the error amplifier even if a resistor element is inserted.

Although the resistor element is inserted between the output of the error amplifier and the output terminal, the resistance value of the resistor element, when viewed from the output terminal side, appears to be the reciprocal of the amplification factor of the error amplifier. Thus, the resistor element does not affect the DC voltage at the output terminal.

The high-frequency component at the output terminal is attenuated by a low-pass filter which is substantially constituted by the resistive element and capacitive element, and the attenuated high-frequency component is fed back to the error amplifier. Therefore, oscillation can be prevented even if a phase delay occurs in the signal at the output terminal due to the output resistance of the error amplifier, the resistor element and the capacitive load.

However, if this phase compensation technique is to be applied to the power supply regulator circuit, the oscillation can be prevented but the input/output voltage difference of the regulator circuit increases by a degree corresponding to a voltage drop due to the inserted resistor element and load current.

If the above-described well-known means for capacitive load driving is to be applied to the conventional DC power supply voltage regulator circuit, oscillation can be prevented but the input/output voltage difference increases. Thus, the range of applications of this well-known means is limited.

BRIEF SUMMARY OF THE INVENTION

According to an aspect of the present invention, there is provided a DC power supply voltage regulator circuit including an input terminal, an output terminal and a reference terminal, comprising: a first output transistor group with a current path having one end connected to the input terminal and the other end connected to the output terminal; a second output transistor group with a current path having one end connected to the input terminal, the second output transistor group having a lower current driving performance than the first output transistor group; a resistor element having one end connected to the other end of the current path of the second output transistor group and the other end connected to the output terminal; a reference voltage generating circuit which is connected to the reference terminal and outputs a reference voltage; a voltage-dividing circuit which divides a voltage between the output terminal and the reference terminal; a resistive element having one end to which an output voltage from the voltage-dividing circuit is applied; an error amplifier having a first terminal connected to the other end of the resistive element and a second terminal connected to the reference voltage generating circuit, the error amplifier comparing a voltage which is applied to the first terminal and the reference voltage which is applied to the second terminal, and applying a control voltage to control terminals of the first and second output transistor groups, thereby controlling a resistance of the current path of each of the first and second output transistor groups; and a capacitive element having one end connected to the other end of the current path of the second output transistor group, and having the other end connected to the first terminal of the error amplifier.

According to another aspect of the present invention, there is provided a DC power supply voltage regulator circuit including an input terminal, an output terminal and a reference terminal, comprising: a first output transistor with a current path having one end connected to the input terminal and the other end connected to the output terminal; a second output transistor with a current path having one end connected to the input terminal, the second output transistor having a lower current driving performance than the first output transistor; a resistor element having one end connected to the other end of the current path of the second output transistor and the other end connected to the output terminal; a reference voltage generating circuit which is connected to the reference terminal and outputs a reference voltage; a voltage-dividing circuit which divides a voltage between the output terminal and the reference terminal; a resistive element having one end to which an output voltage from the voltage-dividing circuit is applied; an error amplifier having a first terminal connected to the other end of the resistive element and a second terminal connected to the reference voltage generating circuit, the error amplifier comparing a voltage which is applied to the first terminal and the reference voltage which is applied to the second terminal, and applying a control voltage to control terminals of the first and second output transistors, thereby controlling a resistance of the current path of each of the first and second output transistors; and a capacitive element having one end connected to the other end of the current path of the second output transistor, wherein a channel width of the first output transistor is greater than a channel width of the second output transistor.

DETAILED DESCRIPTION OF THE INVENTION

Figure 1:
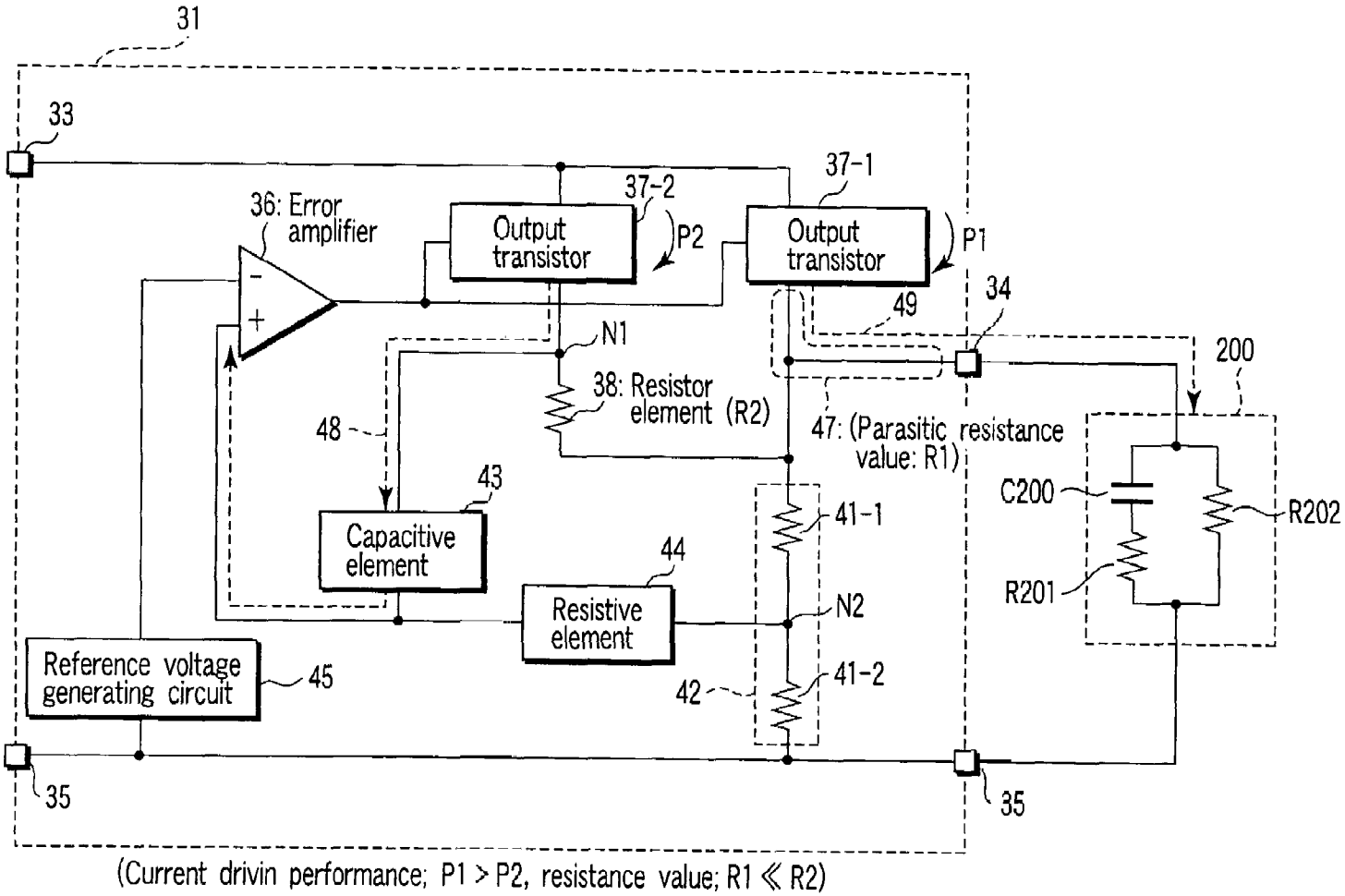
FIG. 1 is a circuit diagram for describing a DC power supply voltage regulator circuit according to a first embodiment of the present invention.

Embodiments of the present invention will now be described with reference to the accompanying drawings. In the description below, common parts are designated by like reference numerals throughout the drawings.

First Embodiment

To begin with, a DC power supply voltage regulator circuit according to a first embodiment of the invention is described with reference to FIG. 1.

As is shown in FIG. 1, a DC power supply voltage regulator circuit 31 comprises output transistors 37-1 and 37-2, a reference voltage generating circuit 45, an error amplifier 36, voltage-dividing resistor elements 41-1 and 41-2 (voltage-dividing circuit 42), a resistor element 38, a capacitive element 43 and a resistive element 44.

One end of a current path of the output transistor 37-1 is connected to an input terminal 33, and the other end of the current path is connected to an output terminal 34. One end of a current path of the output transistor 37-2 is connected to the input terminal 33, and the other end of the current path is connected to a connection node N1.

A current driving performance P1 of the output transistor 37-1 is designed to be higher than a current driving performance P2 of the output transistor 37-2 (P1>P2).

An output terminal of the error amplifier 36 is commonly connected to control terminals of the output transistors 37-1 and 37-2. A first input terminal of the error amplifier 36 is connected to one end of the capacitive element 43 and one end of the resistive element 44. A reference voltage, which is output from the reference voltage generating circuit 45, is applied to a second input terminal of the error amplifier 36. The error amplifier 36 compares the reference voltage and the voltage that is applied to the first input terminal, thereby controlling the voltage at the control terminals of the output transistors 37-1 and 37-2 and stabilizing the output voltage of the DC power supply voltage regulator circuit.

The voltage dividing circuit 42 is configured to divide the voltage between the output terminal 34 and a reference terminal 35. As an example of the voltage-dividing circuit 42, voltage-dividing elements 41-1 and 41-2 are provided between the output terminal 34 and reference terminal 35.

The voltage-dividing element 41-1 has one end connected to the output terminal 34 and the other end connected to a voltage-division node N2. The voltage-dividing element 41-2 has one end connected to the voltage-division node N2 and the other end connected to the reference terminal 35.

The resistor element 38 has one end connected to the connection node N1 and the other end connected to the output terminal 34.

Preferably, the resistor element 38 should be configured such that a resistance value R2 thereof is set to be greater than a resistance value R1 of a parasitic resistance of a region 47 between the said other end of the current path of the output transistor 37-1 and the output terminal 34 (R1<<R2). Ideally, it is desirable that R1=0Ω. For example, in a case where the resistor element 38 is formed of a metal wire itself, it is preferable that the width of the metal wire be decreased or the length thereof be increased.

The other end of the capacitive element 43 is connected to the connection node N1. The capacitive element 43 is configured so as to constitute a feedback path for phase compensation.

The other end of the resistive element 44 is connected to the voltage-division node N2. An output voltage of the voltage-dividing circuit 42 is applied to the said other end of the resistive element 44. The resistive element 44 is configured to prevent a load 200 on the regulator circuit 31 from becoming a load on a feedback signal for phase compensation.

The resistive element 44 and capacitive element 43 constitute a low-pass filter and attenuate a high-frequency component of a signal that is fed back from the output terminal 34 to the error amplifier 36.

The load 200 (i.e. load on the regulator circuit 31) is connected between the output terminal 34 and the reference terminal 35.

The load 200 is an ordinary capacitive load. For example, the load 200, as shown in FIG. 1, can be approximated by an equivalent series resistance of resistors R201 and R202 and a capacitor C200.

The capacitor C200 is composed of, e.g. a chip multilayer ceramic capacitor. The equivalent series resistance thereof is 100 mΩ or less, for instance.

In a case where a desired output voltage is equal to an output voltage of the reference voltage generating circuit 45, it is possible to dispense with the voltage-dividing resistor elements 41-1 and 41-2.

Next, the phase compensation operation of the DC power supply voltage regulator circuit 31 according to the first embodiment is described.

In The DC power supply voltage regulator circuit 31 divides a voltage between both ends of the capacitive load 200 into a DC component, a low-frequency component and a high-frequency component, and takes out these components from the connection node N1 as a feedback signal for phase compensation and feeds back them to the feedback terminal of the error amplifier 36.

The DC component and low-frequency component of the voltage between both ends of the load 200 are fed back to the error amplifier 36 via the resistive element 44. Even if the resistor element 44 is inserted, since the input resistance of the error amplifier 36 is very high, the DC component of the voltage.

The high-frequency component at both ends of the capacitive load 200 is attenuated by the low-pass filter that is substantially constituted by the resistive element 44 and capacitive element 43, and the attenuated high-frequency component is fed back to the input terminal of the error amplifier 36.

Thus, even in the case where a phase delay occurs in the signal the output terminal 34, due to the output resistance of the and capacitive load 200, no oscillation will occur.

If the resistor element 38 is viewed from the output terminal 34 side, the resistance value of the resistor element 38 appears to be the reciprocal of the amplification factor of the error amplifier 36. Hence, the DC voltage at the output terminal 34 of the resistor element 38 is not affected.

The current path of the output transistor 37-1 has no relation to the feedback path 48 to the input terminal of the error amplifier 36. The voltage-dividing resistor elements 41-1 and 41-2 output terminal 34 to the error amplifier 36.

From the viewpoint of phase compensation, the output transistor 37-1 and voltage-dividing resistor elements 41-1 and 41-2 appear to be different from the above-described prior-art phase compensation circuit, which is disclosed in Michio Okamura, "Design of OP AMP Circuit (Second Series)", CQ Publishing Co., Ltd., Nov. 5, 1978. However, as described above, the output transistor 37-1 and voltage-dividing resistor elements 41-1 and 41-2 have no relation, from the viewpoint of phase compensation.

Thus, the phase compensation, which is illustrated in FIG. 1, is carried out by using a technique that is, in principle, similar to the prior art.

Next, the operation of the output transistors 37-1 and 37-2 in the case of ignoring the viewpoint of the principle of phase compensation is described.

An electric current, which is input from the input terminal 33, is separately supplied to the feedback path 48 and to an output path 49 by the output transistors 37-1 and 37-2. A current driving performance P1 of the output transistor 37-1 is designed to be higher than a current driving performance P2 of the output transistor 37-2 (P1>P2).

If the output transistor 37-1 is not provided in the DC power supply voltage regulator circuit 31, the entire current from the input terminal 33 flows to the resistor element 38 via the output transistor 37-2. As a result, a current flowing through the resistor element 38 and a voltage drop between both ends of the resistor element 38 would increase, leading to an increase in the potential difference.

In fact, the confirmation and adjustment of the effect can be performed by a circuit simulation such as SPICE (Simulation Program with Integrated Circuit Emphasis). More desirable characteristics can be obtained by adjusting the dimensions of the transistor by such circuit simulation.

As described above, in the DC power supply voltage regulator circuit according to the present embodiment, the resistor element 38 is provided between the output terminal 34 of the regulator circuit 31 and the output transistor 37-2.

Thus, the DC component, high-frequency component of the voltage between both ends of the capacitive load 200 can be taken out of the connection at node N1 as a feedback signal for phase compensation and can be fed back to the input terminal of the error amplifier 36, and thereby phase compensation can be executed (i.e. oscillation can be prevented).

Furthermore, there is provided the output transistor 37-1 which is designed to have the higher current driving performance P1 than the current driving performance P2 of the output transistor 37-2 (P1>P2).

As a result, the input/output voltage difference between the input terminal 33 and output terminal 34 can be reduced, and the regulator circuit 31 can be used for a wider range of applications.

Besides, since the resistor element 38 decreases, the area that is occupied by the resistor element 38 can be reduced, and finer microfabrication and higher integration density can advantageously be achieved.

Second Embodiment

Next, a DC power supply voltage regulator circuit according to a second embodiment of the invention is described with reference to FIG. 2.

This embodiment relates to an example using a CMOS (Complementary Metal-Oxide Semiconductor) integrated circuit that is fabricated on a P-type substrate. The DC power supply voltage regulator circuit 31 outputs a positive voltage. A description of the parts in this embodiment, which are common to those of the preceding embodiment, is omitted.

Figure 2:
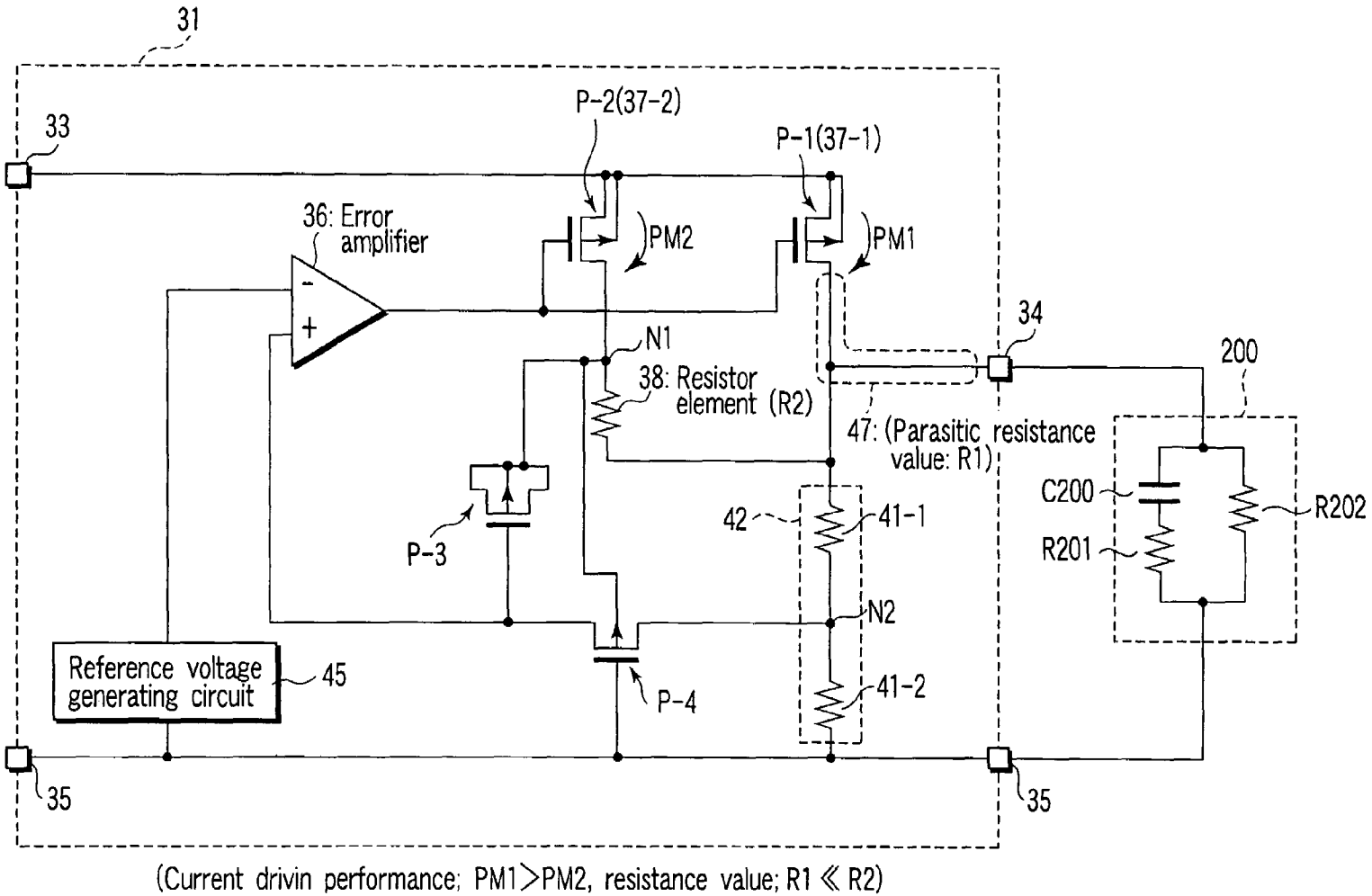
FIG. 2 is a circuit diagram showing a DC power supply voltage regulator circuit according to a second embodiment of the present invention.

As is shown in FIG. 2, a P-type MOS transistor P-1 is provided as the output transistor 37-1. One of the source and drain of the P-type MOS transistor P1 is connected to the input terminal 33, and the other of the source and drain is connected to the output terminal 34. The gate of the P-type MOS transistor P1 is connected to the output terminal of the error amplifier 36, and the back gate thereof is connected to the input terminal 33.

A P-type MOS transistor P-2 is provided as the output transistor 37-2. One of the source and drain of the P-type MOS transistor P2 is connected to the input terminal 33, and the other of the source and drain is connected to the connection node N1. The gate of the P-type MOS transistor P2 is connected to the output terminal of the error amplifier 36, and the back gate thereof is connected to the input terminal 33.

A current driving performance PM1 of the P-type MOS transistor P-1 is designed to be higher than a current driving performance PM2 of the output transistor P-2.

Specifically, the channel width of the P-type MOS transistor P-1 is designed to be greater than the channel width of the P-type MOS transistor P-2.

To be more specific, it is desirable that the channel width of the P-type MOS transistor P-1 be, e.g. about 100 times greater than the channel width of the P-type MOS transistor P-2.

In this case, the drain/source voltage of the transistor P-1 cannot greatly be decreased since it affects a loop gain. However, since the drain/source voltage of the transistor P-2 does not affect a DC loop gain, the drain/source voltage of the transistor P-2 can be decreased. Therefore, the current driving performances of the transistors P-1 and P2 can be set to have the above-described relationship (PM1>PM2).

Since the MOS transistor has good controllability of the drain/source resistance, the minimum voltage between output terminals can relatively easily be reduced.

The resistor element 38 is formed by using, e.g. a polysilicon resistor, a metal wire resistor, a diffusion resistor, etc.

Polysilicon resistors or diffusion resistors, for instance, are used for the voltage-dividing resistor elements 41-1 and 41-2.

The reference voltage generating circuit 45 is, for example, a band gap reference circuit.

A P-type MOS transistor P-3 is provided as the element. The source, drain and back gate of the P-type MOS transistor P-3 are connected to the connection node N1, and the gate thereof is connected to the input terminal of the error amplifier 36.

A P-type MOS transistor P-4 is provided as the resistive element. One of the source and drain of the P-type MOS transistor P-4 is connected to the voltage-division node N2, and the other of the source and drain is connected to the input terminal of the error amplifier 36. The gate of the P-type MOS transistor P-4 is connected to the reference terminal 35, and the back gate thereof is connected to the connection node N1.

By using the MOS-FETs, like the transistors P-3 and P-4, the area that is occupied can be reduced.

It is desirable that the back gates of the P-type MOS transistors P-3 and P-4, which are used as the capacitive element and resistive element, be connected to the connection node N1 between the drain of the transistor P-2 and the resistor element 38.

If the back gates of the P-type MOS transistors P-3 and P-4 are connected as described above, the electrostatic capacitance between the output terminal 34 and the input terminal of the error amplifier 36 can be increased to a relatively high level.

Like the above-described case, the dimensional adjustment can be made on the basis of the result of a simulation such as SPICE, and the stable operation and the response speed may be balanced. Thereby, the characteristics can be improved.

In the above-described structure, the MOS transistors P-1 to P-4 are used for the output transistors 37-1, 37-2, capacitive element 43 and resistive element 44. Therefore, compared to the case of using a capacitive element, which makes use of a capacitance between metal wires, and a polysilicon resistor or a diffusion resistor element, the area that is occupied can be reduced and a higher circuit integration density can advantageously be achieved.

Third Embodiment

Figure 3:
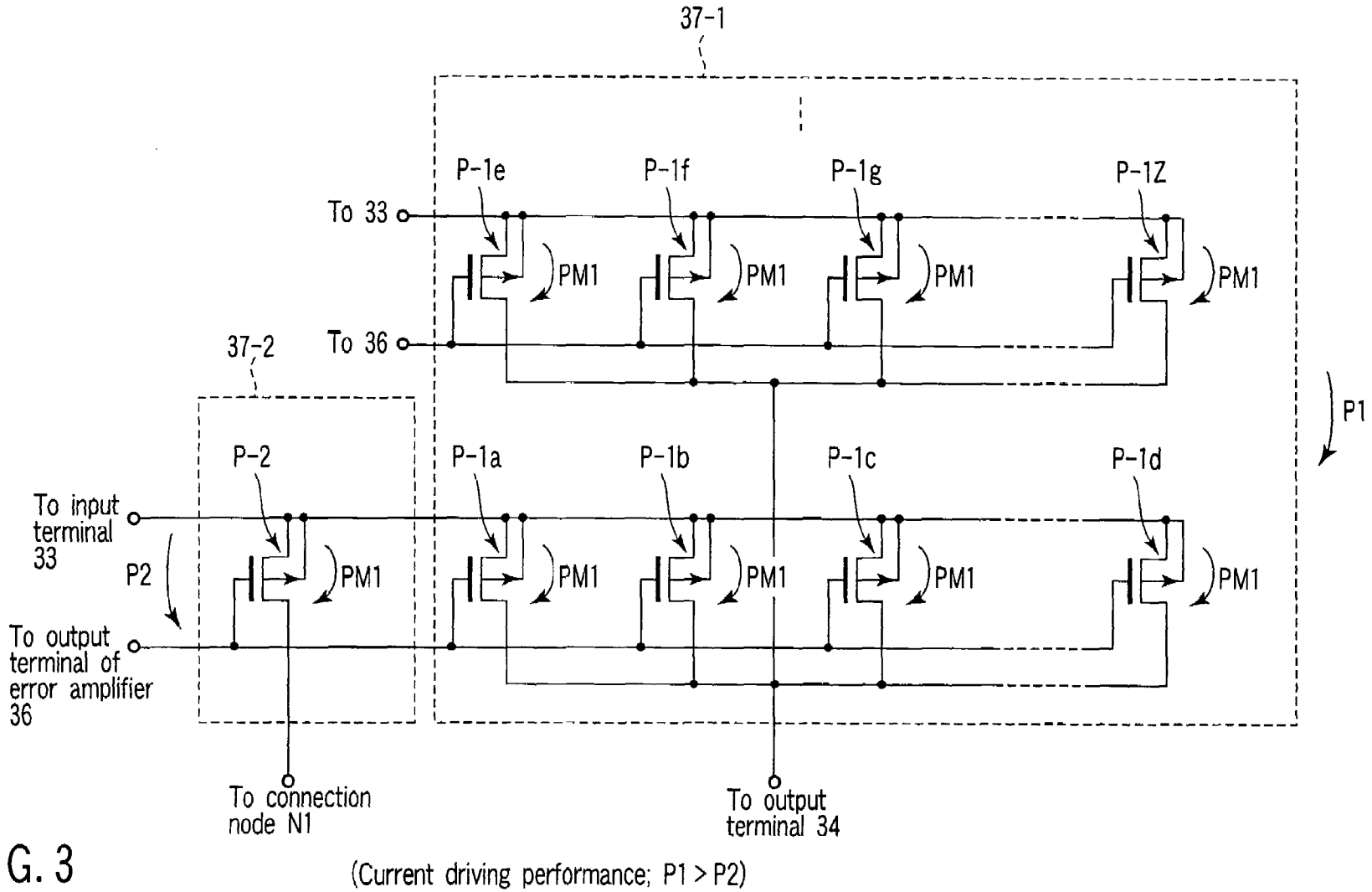
FIG. 3 is a circuit diagram showing a DC power supply voltage regulator circuit according to a third embodiment of the present invention.

Next, a DC power supply voltage regulator circuit according to a third embodiment of the invention is described with reference to FIG. 3. FIG. 3 is a view for describing the DC power supply voltage regulator circuit according to the third embodiment. FIG. 3 is a circuit diagram showing concrete examples of the output transistors 37-1 and 37-2. A description of the parts common to those of the preceding embodiments is omitted.

As-is shown in FIG. 3, the output transistor 37-1 includes a plurality of P-type MOS transistors P-1*a* to P-1*z* which are connected in parallel and have gates commonly connected to the output terminal of the error amplifier 36, and have sources and drains mutually connected.

The output transistor 37-2 is, like the above-described case, includes a single P-type MOS transistor P-2.

The transistors P-1*a* to P-1*z* and P-2 are arrayed and configured such that each of these transistors has the same current driving performance PM1.

Thus, a total current driving performance P1 of the output transistor 37-1 including the transistors P-1*a* to P-1*z*, which operate in parallel and have the same current driving performance PM1, is designed to be greater than a current driving performance P2 of the output transistor 37-2 including the single transistor P-2, which has the driving performance PM1 (P1>P2).

According to this structure, the same advantageous effects as with the above-described embodiments can be obtained.

Further, the relationship in connection of the arrayed transistors P-1*a* to P-1*z* and P-2 may be chosen as described above. Thus, the relationship in connection can be made easier, and the manufacturing cost can advantageously be reduced.

As has been described above, according to the structures of the embodiments, the resistor is inserted between the output terminal of the output transistor and the output terminal of the DC power supply voltage regulator circuit. The signal, which is taken out of the connection node between the output terminal of the output transistors and the resistor, is used for phase compensation. Thereby, using the prior art, oscillation is prevented from being caused by a phase delay due to the capacitive load connected to the output of the regulator circuit. Furthermore, the output transistor is composed of a plurality of parallel-connected transistors. The above-mentioned resistor is inserted only between one of the transistors and the output terminal. Since the resistor is inserted only between one of the transistors and the output terminal, there is such an advantage that the voltage drop due to the inserted resistance does not increase the minimum value of the input/output voltage difference of the regulator circuit.

It is thus possible to obtain a DC power supply voltage regulator circuit which can easily prevent oscillation, without increasing the input/output voltage difference.

In the descriptions of the second and third embodiments, in the applied example of the output transistors 37-1 and 37-2, only the source-grounded P-channel MOS transistors are used. Similarly, drain-grounded N-channel MOS transistors can be used. In addition, bipolar transistors, etc. can be applied to the output transistors 37-1 and 37-2.

In the embodiments, a description is given only to the case of using the single P-type MOS transistor as the output transistor 37-2. However, needless to say, a plurality of transistors are applicable to the output transistor 37-2 if the total current driving performance P1 of the output transistor 37-1 is higher than the total current driving performance P2 of the output transistor 37-2 (P1>P2).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A DC power supply voltage regulator circuit including an input terminal, an output terminal and a reference terminal, comprising:

a first output transistor group with a current path having one end connected to the input terminal and the other end connected to the output terminal;

a second output transistor group with a current path having one end connected to the input terminal, the second output transistor group having a lower current driving performance than the first output transistor group;

a resistor element having one end connected to the other end of the current path of the second output transistor group, and the other end connected to the output terminal;

a reference voltage generating circuit which is connected to the reference terminal and outputs a reference voltage;

a voltage-dividing circuit which divides a voltage between the output terminal and the reference terminal;

a resistive element having one end to which an output voltage from the voltage-dividing circuit is applied;

an error amplifier having a first terminal connected to the other end of the resistive element and a second terminal connected to the reference voltage generating circuit, the error amplifier comparing a voltage which is applied to the first terminal and the reference voltage which is applied to the second terminal, and applying a control voltage to control terminals of the first and second output transistor groups, thereby controlling a resistance of the current path of each of the first and second output transistor groups; and a capacitive element having one end connected to the other end of the current path of the second output transistor group.

2. The DC power supply voltage regulator circuit according to claim 1, wherein the first output transistor group comprises a plurality of transistors having current paths connected in parallel at one end and the other end thereof.

3. The DC power supply voltage regulator circuit according to claim 1, wherein the second output transistor group comprises at least one transistor with a current path having one end and the other end connected between the input terminal and said one end of the resistor element.

4. The DC power supply voltage regulator circuit according to claim 1, wherein the first output transistor group comprises a first MOS transistor having one of a source and a drain connected to the input terminal and the other of the source and the drain connected to the output terminal, the first MOS transistor having a gate to which the control voltage of the error amplifier is applied and having a back gate connected to the input terminal.

5. The DC power supply voltage regulator circuit according to claim 1, wherein the second output transistor group comprises a second MOS transistor having one of a source and a drain connected to the input terminal and the other of the source and the drain connected to said one end of the resistor element, the second MOS transistor having a gate to which the control voltage of the error amplifier is applied and having a back gate connected to the input terminal.

6. The DC power supply voltage regulator circuit according to claim 1, wherein the capacitive element is a third MOS transistor having a source, a drain and a back gate connected to said one end of the resistor element, and having a gate connected to the first terminal of the error amplifier.

7. The DC power supply voltage regulator circuit according to claim 1, wherein the resistive element is a fourth MOS transistor having one of a source and a drain connected to the first terminal of the error amplifier, and having the other of the source and the drain, to which the output voltage of the voltage-dividing circuit is applied, the fourth MOS transistor having a gate connected to the reference terminal and a back gate connected to said one end of the resistor element.

8. The DC power supply voltage regulator circuit according to claim 1, wherein the voltage-dividing circuit comprises a plurality of voltage-dividing resistor elements each having one end and the other end connected in series between the output terminal and the reference terminal.

9. The DC power supply voltage regulator circuit according to claim 1, wherein the resistor element has a resistance value which is higher than a resistance value of a parasitic resistance between the other end of the current path of the first output transistor group and the output terminal.

10. A DC power supply voltage regulator circuit including an input terminal, an output terminal and a reference terminal, comprising:

a first output transistor with a current path having one end connected to the input terminal and the other end connected to the output terminal;

a second output transistor with a current path having one end connected to the input terminal, the second output transistor having a lower current driving performance than the first output transistor;

a resistor element having one end connected to the other end of the current path of the second output transistor and the other end connected to the output terminal;

a reference voltage generating circuit which is connected to the reference terminal and outputs a reference voltage;

a voltage-dividing circuit which divides a voltage between the output terminal and the reference terminal;

a resistive element having one end to which an output voltage from the voltage-dividing circuit is applied;

an error amplifier having a first terminal connected to the other end of the resistive element and a second terminal connected to the reference voltage generating circuit, the error amplifier comparing a voltage which is applied to the first terminal and the reference voltage which is applied to the second terminal, and applying a control voltage to control terminals of the first and second output transistors, thereby controlling a resistance of the current path of each of the first and second output transistors; and a capacitive element having one end connected to the other end of the current path of the second output transistor, wherein a channel width of the first output transistor is greater than a channel width of the second output transistor.

11. The DC power supply voltage regulator circuit according to claim 10, wherein the channel width of the first output transistor is about 100 times greater than the channel width of the second output transistor.

12. The DC power supply voltage regulator circuit according to claim 10, wherein the first output transistor comprises a first MOS transistor having one of a source and a drain connected to the input terminal and the other of the source and the drain connected to the output terminal, the first MOS transistor having a gate to which the control voltage of the error amplifier is applied and having a back gate connected to the input terminal.

13. The DC power supply voltage regulator circuit according to claim 10, wherein the second output transistor comprises a second MOS transistor having one of a source and a drain connected to the input terminal and the other of the source and the drain connected to said one end of the resistor element, the second MOS transistor having a gate to which the control voltage of the error amplifier is applied and having a back gate connected to the input terminal.

14. The DC power supply voltage regulator circuit according to claim 10, wherein the capacitive element is a third MOS transistor having a source, a drain and a back gate connected to said one end of the resistor element, and having a gate connected to the first terminal of the error amplifier.

15. The DC power supply voltage regulator circuit according to claim 10, wherein the resistive element is a fourth MOS transistor having one of a source and a drain connected to the first terminal of the error amplifier, and having the other of the source and the drain, to which the output voltage of the voltage-dividing circuit is applied, the fourth MOS transistor having a gate connected to the reference terminal and a back gate connected to said one end of the resistor element.

16. The DC power supply voltage regulator circuit according to claim 10, wherein the voltage-dividing circuit comprises a plurality of voltage-dividing resistor elements each having one end and the other end connected in series between the output terminal and the reference terminal.

17. The DC power supply voltage regulator circuit according to claim 10, wherein the resistor element has a resistance value which is higher than a resistance value of a parasitic resistance between the other end of the current path of the first output transistor and the output terminal.

* * * * *